US006263772B1

(12) United States Patent
Navot et al.

(10) Patent No.: US 6,263,772 B1
(45) Date of Patent: Jul. 24, 2001

(54) DEVICE FOR OPENING PACKETS AND FOR DISPENSING THE CONTENTS THEREOF

(75) Inventors: Yoram Navot, Omer; Amit Avigdor, Tzur Yigal; Eran Gazit, Rishon Lezion, all of (IL)

(73) Assignee: Gazit-Navot Holding Ltd., Omer (IL)

( * ) Notice: Subject to any disclaimer, the term of this patent is extended or adjusted under 35 U.S.C. 154(b) by 0 days.

(21) Appl. No.: 09/341,290

(22) PCT Filed: Jan. 8, 1998

(86) PCT No.: PCT/IL98/00010

§ 371 Date: Jul. 8, 1999

§ 102(e) Date: Jul. 8, 1999

(87) PCT Pub. No.: WO98/30489

PCT Pub. Date: Jul. 16, 1998

(30) Foreign Application Priority Data

Jan. 8, 1997 (IL) ..... 119980

(51) Int. Cl.[7] ..... B26D 1/00; B67B 7/00

(52) U.S. Cl. ..... 83/13; 30/2; 30/123; 7/156; 7/158; 222/80; 222/103

(58) Field of Search ..... 30/2, 279.2, 280, 30/294, 366, 123, DIG. 3; 222/80, 81, 82, 103; 83/13; 7/156, 158

(56) References Cited

U.S. PATENT DOCUMENTS

| | | | | |
|---|---|---|---|---|
| 3,418,059 | * | 12/1968 | Robe | 222/103 |
| 4,570,339 | * | 2/1986 | Taylor | 30/2 |
| 5,101,562 | * | 4/1992 | Horvath et al. | 30/2 |
| 5,857,593 | * | 1/1999 | Patronaggio | 222/103 |

* cited by examiner

*Primary Examiner*—Hwei-Slu Payer
(74) *Attorney, Agent, or Firm*—Mark M. Friedman

(57) ABSTRACT

A device (2) for effecting opening of a sealed bag-like flexible packet (4) and for dispensing its contents. The device (2) includes two interconnected limbs (6, 8), each limb includes an inside (12) and an outside (10) surface, and is of a size at least equal to one dimension of the packet (4), to facilitate placing the packet (4) in between the limbs (6, 8). The device (2) also includes a mechanism (32, 36) located at the end portions of the limbs (6, 8) facilitating piercing or cutting the packet (4) to form an opening (38), allowing the contents to be dispensed upon effecting a sequential squeezing action on the packet (4) starting from a point distant from the opening (38).

8 Claims, 3 Drawing Sheets

DEVICE FOR OPENING PACKETS AND FOR DISPENSING THE CONTENTS THEREOF

BACKGROUND OF THE INVENTION

The present invention relates to a device for effecting the opening of sealed bag-like flexible packets and for dispensing the pourable contents thereof.

Sealed bag-like, flexible packets containing pourable substances are widely used. Such packets may contain comestible substances, such as ketchup, mustard, mayonnaise, various types of sauces, or other type of substances, e.g., adhesives, sealing materials and the like. In order to preserve the substances contained in the packets for a long period of time (long shelf life), the packets are usually made of air-tight multi-ply materials such as foil and plastic. While the packets are indeed effective in preserving their contents in good condition for an extended period of time, and are mechanically strong, withstanding abuses, the user has a difficult time in opening the packets unless a special tool such as scissors or knives are provided. The per-se known notch or cut provided at the lateral edge of such a rectangular packet does assist in the task of opening the packet by tearing along the notch or cut, however, such an operation more often than not, results in spilling, or worse, spraying the surroundings with the contents thereof.

SUMMARY OF THE INVENTION

It is therefore a broad object of the present invention to provide a device for effecting the opening of a sealed, bag-like flexible packet and for dispensing the pourable contents thereof in a controlled manner.

In accordance with the present invention there is provided a device for effecting opening of a sealed bag-like flexible packet and for dispensing pourable contents thereof; comprising two interconnected limbs each having an inside and an outside surface and having a size at least equal to one dimension of said packet, so as to facilitate placing of said packet in between said limbs, and means located at the end portions of said limbs facilitating piercing or cutting of said packet to form an opening allowing the contents thereof to be dispensed upon effecting a sequential squeezing action on said packet starting from a point distant from said opening.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

DESCRIPTION OF THE PREFERRED EMBODIMENTS

Figure 1:
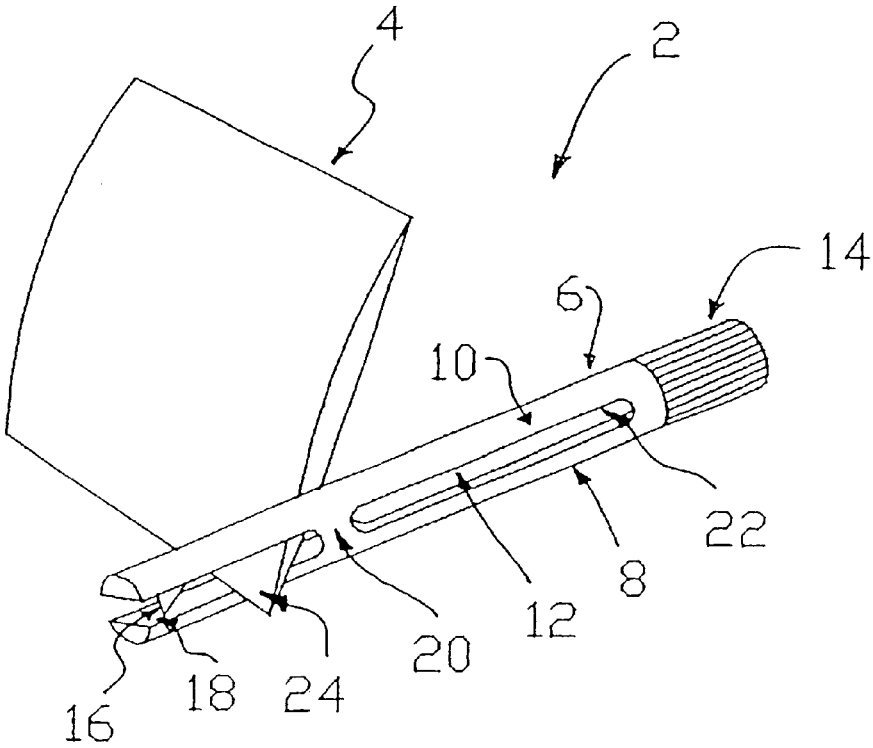
FIG. 1 illustrates the device for opening a sealed bag-like packet and for the dispensing of the contents thereof, according to the invention.
Figure 2:
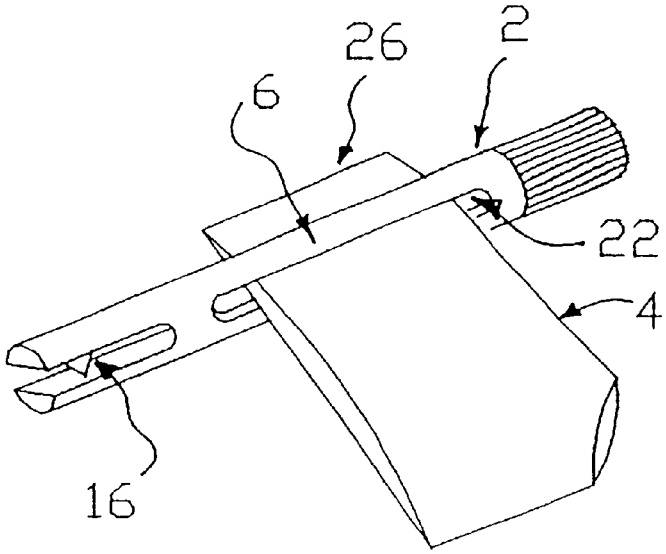
FIG. 2 illustrates the manner of using the device of FIG. 1 for dispensing the contents thereof.

There is shown in FIGS. 1 and 2 a device for effecting the opening of a sealed, bag-like, flexible packet 4. The device 2 is composed of two interconnected limbs 6 and 8 in the form of a rod or bar, each having an outside surface and an inside surface. For clarity, it is sufficient to designate the outside surface of limb 6, by the number 10 and the inside surface of limb 8, by the number 12. The limbs 6 and 8 are interconnected at one end, constituting a handle 14. The limb 6 is fitted at its other free end with a blade 16, the plane of which extends in the direction of the axes of the limbs. The inner surface 12 of limb 8 may be provided with a groove 18 for accommodating the edge of the triangularly shaped blade 16. The limbs 6 and 8 may be further interconnected along their length at 20, so as to form a slot-like opening 22. Preferably, but not necessarily, the limbs 6 and 8 are made of flexible material such as plastic, for reasons which will become more apparent hereinafter.

In operation, in order to use the contents of the packet 4, one of its corners 24 is inserted in between the limb portions adjacent to the blade 16, as shown in FIG. 1 and the corner is cut away. The uncut end portion 26 of the packet 4 is then inserted into the opening 22 in between the limbs 6 and 8. The dispensing of the contents of the packet can now be effected either by squeezing the limbs toward each other while sliding the device along the packet towards the cut-away opening, or by gripping the handle 14 and revolving the device about its axis while keeping the edge 26 held in the opening 22.

Figure 3:
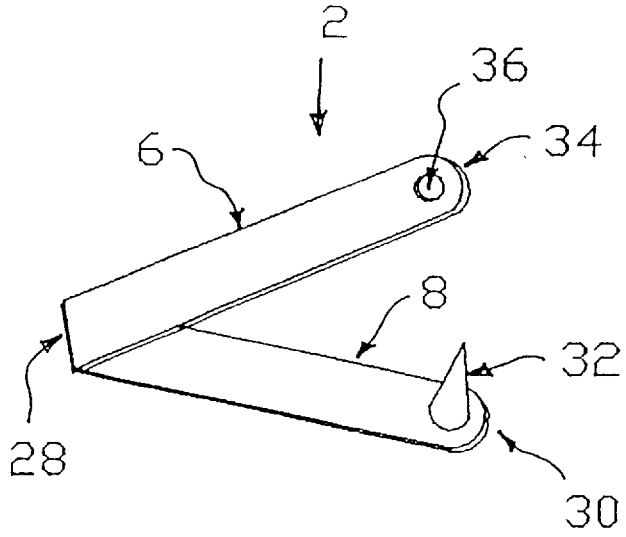
FIGS. 3 to 5 illustrate a further embodiment of the device according to the invention and the manner of utilizing same for dispensing the contents of the packet.
Figure 4:
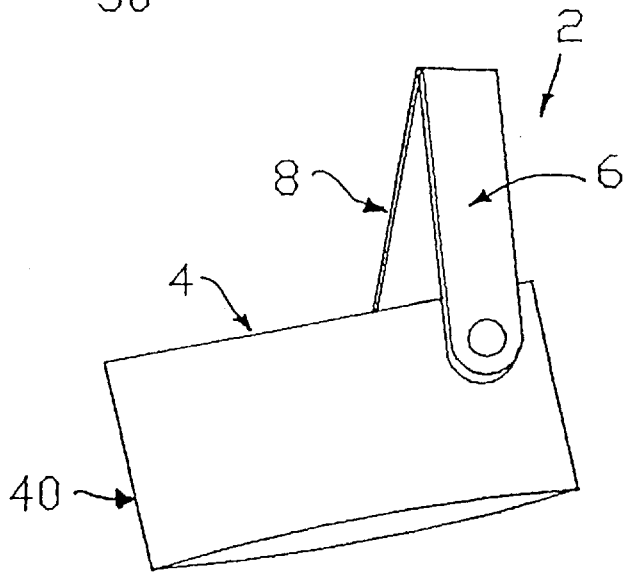
Figure 5:
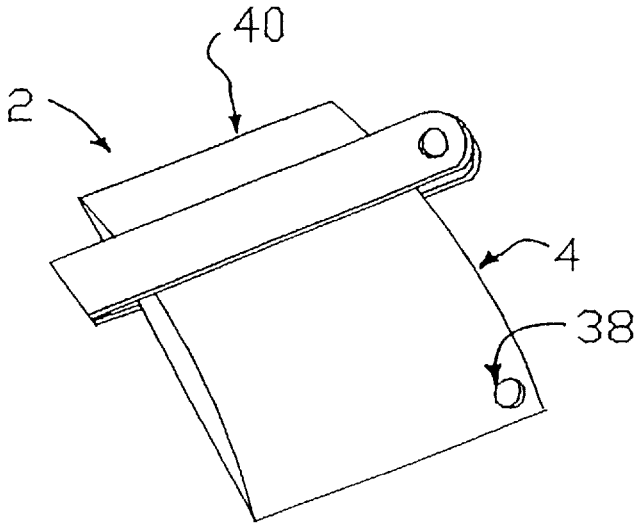

Referring now to FIGS. 3 to 5, there is illustrated a slightly different embodiment than that of FIGS. 1 and 2. Here, the two limbs 6 and 8 are hingedly interconnected to each other at 28. The interconnection may have a spring action quality, so as to render the de vice 2 with a "normally open" state in which the limbs 6 and 8 are spread apart, facilitating the placement of the packet 4 between the limbs for piercing and dispensing actions. The free end 30 of limb 8 is fitted with a pointed edge 32 while the free end 34 of the limb 6 is formed with a hole 36. As seen, the opening 38 is first pierced in the packet 4, preferably close to a corner or edge thereof, and then the opposite side 40 of the pierced packet 4 is placed in between the limbs 6 and 8. The dispensing of the substance in the packet is either effected by a squeezing and sliding action, as illustrated in FIG. 5, or by revolving the device as described with reference to FIG. 1.

Figure 6:
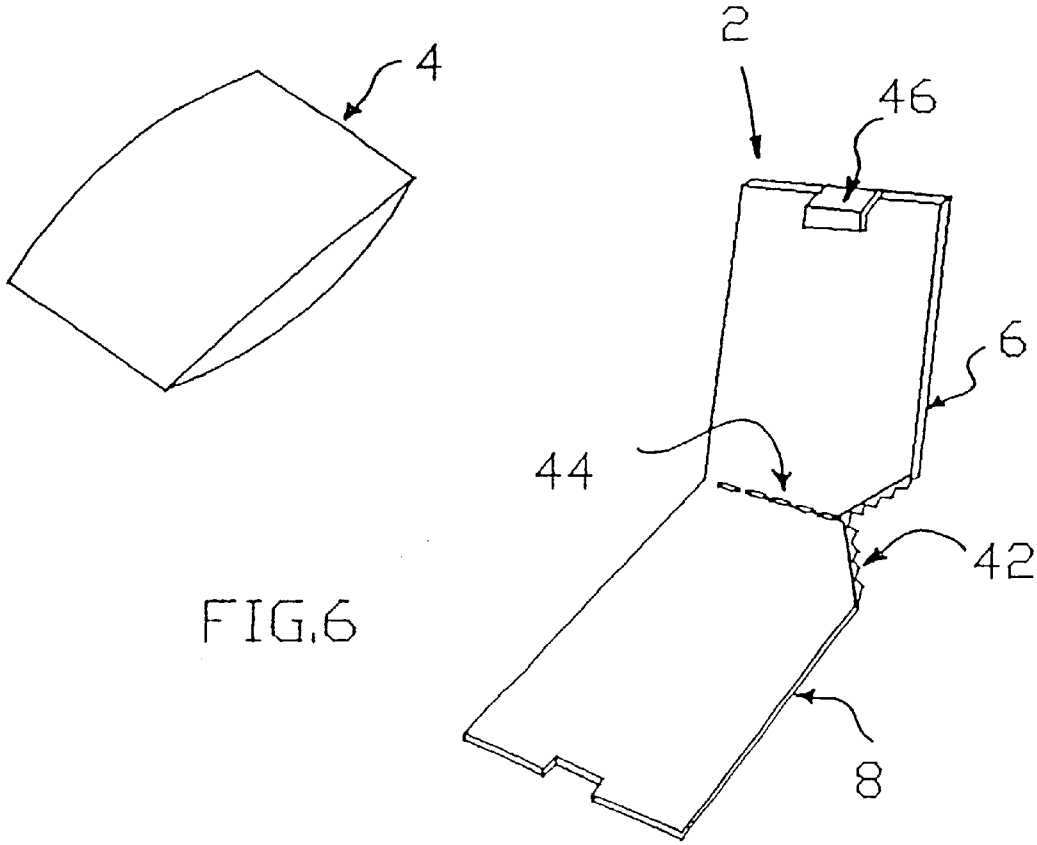
FIGS. 6 and 7 illustrate still a further embodiment of the device according to the present invention and the manner of utilizing same.
Figure 7:
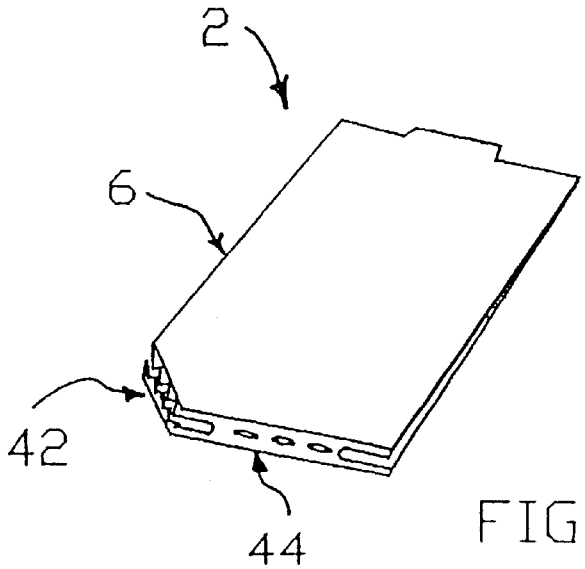

FIGS. 6 and 7 show a modification of the device 2 according to the present invention, in which the limbs 6 and 8 are configured as plates having surface areas substantially the size of the packet surface areas. As further seen, the means facilitating cutting or piercing the packet which are in the form of a toothed blade 42, are located adjacent to the interconnecting portion 44, constituting an integral hinge of the limbs 6 and 8. Upon the placement of the packet 4 in between the plate-shaped limbs 6 and 8, the latter are closed, truncating the corner of the packet. Interengaging lock means 46 keep the plates in their closed state. The device 2 is now ready for dispensing the pourable contents merely by sequentially squeezing or pushing the two plates towards one another.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A method for effecting opening of a rectangular sealed flexible packet having a length, a width and a thickness dimensions and for dispensing pourable contents therefrom comprising:

providing two interconnected limbs each having an inside surface and an outside surface and having equal lengths at least equal to one of said length and width dimensions of said packet said limbs forming a slot opening, and piercing or cutting means at an end portion of at least one of said limbs;

placing one end of said packet adjacent said piercing or cutting means;

piercing or cutting an opening in said packet at said one end thereof;

inserting the other end of said packet in said slot opening;

dispensing said pourable contents from said packet by sequential squeezing action by said surfaces of said limbs against said packet starting at a point distant from said opening of said packet.

2. The method as recited in claim 1, wherein said step of dispensing is effected by squeezing the limbs towards each other while sliding the limbs along the packet toward said one end having the opening.

3. The method as recited in claim 1, wherein said step of dispensing is effected by gripping and revolving the limbs about their axis while retaining the other end of the packet in said slot opening.

4. A method for effecting opening of a rectangular sealed flexible packet having a length, a width and a thickness dimensions) and for dispensing pourable contents therefrom, comprising:

providing two interconnected limbs each having an inside surface and an outside surface and having equal lengths at least equal to one of said length and width dimension of said packet, said limbs forming a slot opening, and piercing or cutting means at free end portions of said limbs;

placing one end of said packet adjacent said piercing or cutting means;

piercing or cutting an opening in said packet at said one end thereof;

inserting the other end of said packet in said slot opening;

dispensing said pourable contents from said packet by sequential squeezing action by said surfaces of said limbs against said packet starting at a point distant from said opening of said packet.

5. A device for effecting opening of a rectangular sealed flexible packet having a length, a width and a thickness dimensions and for dispensing pourable contents therefrom, comprising:

two limbs interconnected to each other at one end thereof to form an interconnected end portion, and having a free end portion at the opposite ends thereof each having an inside surface and an outside surface;

means further interconnecting said limbs intermediate the free end portion and said interconnected end thereof to form a slot opening, said slot opening having a length at least equal to one of said length and width dimensions of said packet, so as to facilitate placing of said packet in between said limbs; and means located at said end portions of said limbs for piercing or cutting of said packet to form an opening, allowing the contents thereof to be dispensed therefrom upon effecting a sequential squeezing action on said packet after placing said packet within said slot opening, starting at a point distant from said opening of said packet.

6. The device as claimed in claim 5, wherein said limbs are in the form of two substantially parallel extending rods or bars.

7. A device for effecting opening of a rectangular sealed flexible packet having a length, a width and a thickness dimensions and for dispensing pourable contents therefrom, comprising:

two limbs each having an inside surface, an interconnected end portion and a free end portion, said two limbs being hingedly interconnected to each other at said interconnected end portions such that said two limbs are closable to a closed position in which said inside surfaces are in facing relation; and means located near said free end portions of said limbs configured for piercing or cutting said packet to form an opening, said means including a pointed edge protruding from an inner surface of one of said limbs and an opening made in the other limb in alignment with said pointed edge, such that, after forming of an opening in said packet, the device is operative to dispense the contents of said packet upon effecting a sequential squeezing action on said packet after closing said packet between said inside surfaces.

8. A device for effecting opening of a rectangular sealed flexible packet having a length, a width and a thickness dimensions and for dispensing pourable contents therefrom, comprising:

two plates each having a periphery and an inside surface, said two plates being hingedly interconnected to each other along a first part of said periphery such that said two plates are closable to a closed position in which said inside surfaces are in facing relation; and means configured for piercing or cutting said packet to form an opening, said means including at least one blade deployed so as to project from said inside surface adjacent to said first part of said periphery, such that closing of said packet between said inside surfaces is operative both to form an opening in said packet and to dispense the contents of said packet through said opening in said packet.

* * * * *